United States Patent [19]

Long

[11] 4,082,066

[45] Apr. 4, 1978

[54] MODULATION FOR FUEL DENSITY IN FUEL INJECTION SYSTEM

[75] Inventor: E. David Long, Elmira, N.Y.

[73] Assignee: Allied Chemical Corporation, Morris Township, N.J.

[21] Appl. No.: 682,701

[22] Filed: May 3, 1976

[51] Int. Cl.[2] ..... F02B 3/00

[52] U.S. Cl. ..... 123/32 EA; 123/32 EF

[58] Field of Search ..... 123/32 EA, 32 AE, 32 AB, 123/32 EF, 139 AW; 137/90, 101.19

[56] References Cited

U.S. PATENT DOCUMENTS

| | | | |
|---|---|---|---|
| 3,605,703 | 9/1971 | Moulds | 123/32 EA |
| 3,831,563 | 8/1974 | Brittain et al. | 123/32 EC |

*Primary Examiner*—Ronald B. Cox

*Attorney, Agent, or Firm*—Ernest D. Buff

[57] ABSTRACT

A fuel injection system employs an electromagnetically actuated injector connected to a source of fuel and a variable width, constant current electrical pulse source controlled by engine operating parameter sensors, to energize an injector coil in timed relation to the engine operation and thereby vary the fuel volume provided to the engine as a function of the parameters. A circuit including the injector coil modifies the time constant of an R-C circuit in the pulse source to modify the pulse width as a function of the voltage across the injector coil, which varies as a function of fuel temperature in the injector to maintain the fuel mole weight provided to the engine independent of variations in the fuel temperature adjacent to the injector.

15 Claims, 3 Drawing Figures

MODULATION FOR FUEL DENSITY IN FUEL INJECTION SYSTEM

BACKGROUND OF THE INVENTION

1. Field of the Invention

This invention relates to a fuel injection system for internal combustion spark ignited engines and more particularly to a system incorporating means for controlling the volume of fuel provided to the engine as a function of the engine operating parameters and for varying the volume of fuel as a function of fuel temperature adjacent to the injectors to maintain the weight of fuel provided independent of fuel temperature variation.

2. Prior Art

Fuel control systems which measure engine operating parameters and inject a metered quantity of fuel into the engine cylinders, in timed relation to the engine operation, as a function of the parameters, provide better control over the fuel-air ratio in the engine cylinders than the more conventional carburetor systems. Since this precise control of the fuel-air ratio can improve the engine's efficiency and decrease the quantity of pollutants in the engine3 s exhaust, the interest in these systems has increased in direct proportion to the cost of fuel and the tightening of government regulations limiting the permissible quantities of undesirable emissions in vehicle exhausts.

Within the engine combustion chambers, the air and fuel react with one another on a weight basis so that it is important to control the weight of fuel provided to the engine rather than its volume; but prior art fuel metering injectors are typically volume measuring devices. A common form of injector consists of a normally closed valve which is opened for a period of time controlled by the engine operating parameters. The pressure to the injector is maintained constant so that a controlled volume of fuel is passed by the injector during the period of time that it opened.

The error in fuel-air ratio that results from controlling the volume of the fuel, rather than its weight, may be considerable since fuel density varies substantially as a function of fuel temperature. A typical gasoline mixture may change in density by about 1% for each temperature change of 10° F. The fuel temperature at the injector may vary from about −20° F during a cold start to about 250° F in a system where the injector is disposed adjacent to the engine intake valve, during warmed up engine operation. The injector temperature stabilizes well below the engine intake valve temperature because of the cooling effect of the fuel. Thus, a substantial fuel density variation will occur and a fuel system which only monitors furl volume may provide a substantially erroneous fuel-air ratio.

SUMMARY OF THE INVENTION

The object of the present invention is to provide means controlled by the temperature of the fuel being injected in the engine cylinders to modify the operation of a volume metering fuel injector to maintain the weight of fuel injected independent of variations in fuel temperature at the injector metering nozzle.

The preferred embodiment of the invention, which will subsequently be disclosed in detail, employs electromagnetically actuated energized injectors. A plurality of engine sensors monitor such parameters as engine manifold pressure and engine temperature to control a variable width pulse generator. In order to render the injector response time independent of the injector coil temperature, and thus its resistance, a constant current driver circuit of the type disclosed in my copending United States Patent Application entitled "A Control Computer for a Fuel Injection System", Ser. No. 629,443, filed Nov. 6, 1975, receives a variable width pulse to actuate the injector. The present invention utilizes the voltage and D.C. resistance of the injector coil during the driving pulse time as a measure of fuel temperature at the injector. Since the current of the injector coil is constant and its resistance varies as a function of temperature, its voltage will vary as a function of temperature. This voltage and D.C. resistance variation is used to modify the discharge time of an R-C circuit in the variable width pulse generator. In this embodiment, no separate fuel temperature sensor is required for sensing the fuel temperature in all injectors for the engine, e.g., for all eight injectors used in an eight cylinder engine.

The injector coil is in close proximity to the injector metering orifice and the coil temperature closely follows the fuel temperature in the injector. The injector temperature is a close measure of the fuel temperature at the injector and accordingly the density of the fuel. Thus, the present invention requires only a few simple electronic components to substantially improve fuel-air ratio control accuracy of fuel injection systems employing volume controlling injectors to render the accuracy of such systems independent of the variation in fuel density with fuel temperature.

The present invention is also applicable to forms of fuel injection systems wherein the injected volume is controlled by means other than an R-C time delay pulse generator or wherein it may be necessary to provide a separate injected fuel temperature sensor.

Other objectives, advantages and applications of the present invention will be made apparent by the following detailed description of a preferred embodiment of the invention. The description makes reference to the accompanying drawings in which:

DETAILED DESCRIPTION OF THE PREFERRED EMBODIMENT

Figure 1:
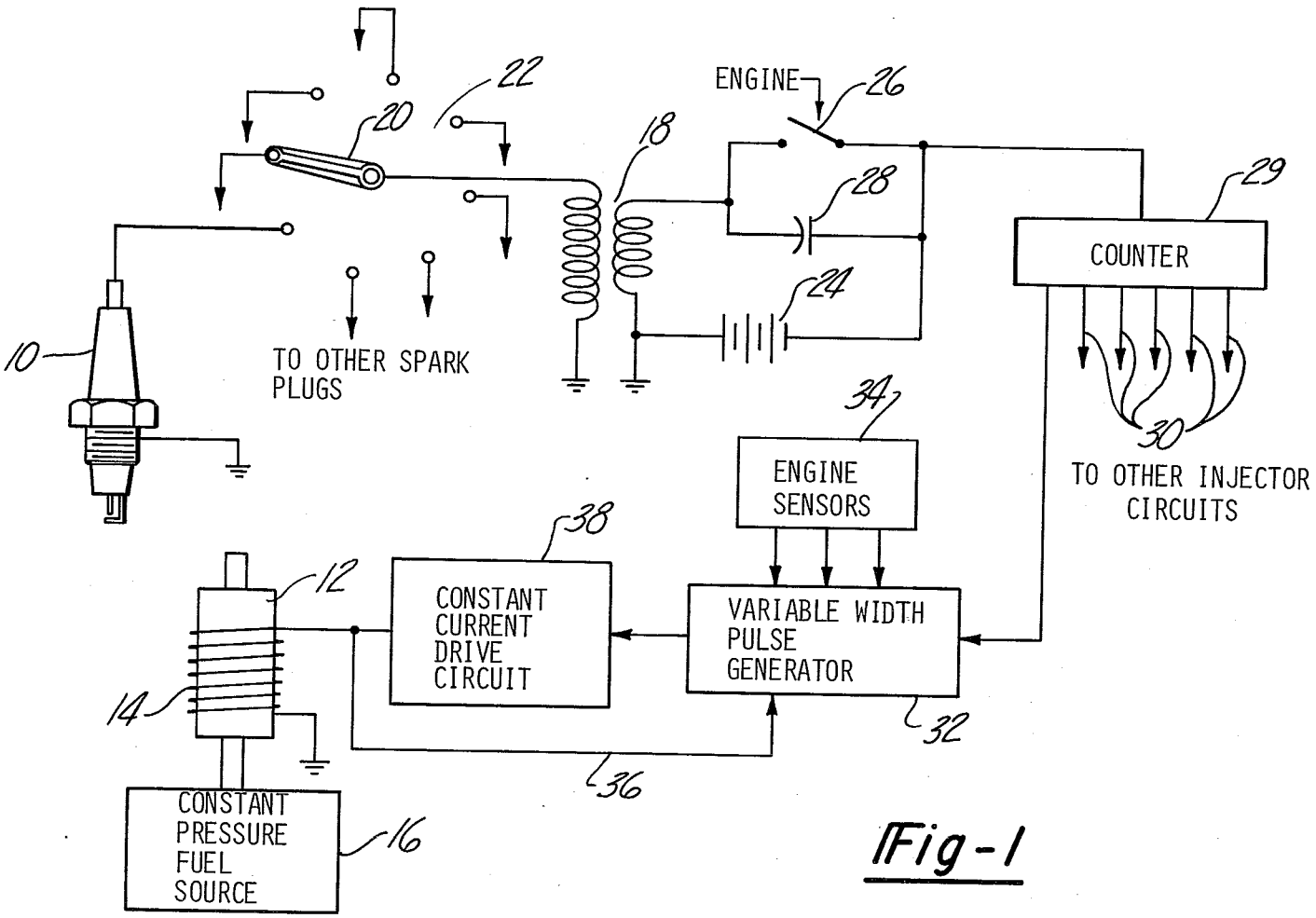
FIG. 1 is a partially schematic, partially block diagram of a fuel injection system having a preferred embodiment of the present invention.

The system of FIG. 1 illustrates the fuel injection system and ignition components associated with a single cylinder of a multi-cylinder, internal combustion spark ignited engine, such as that disclosed in my copending United States Patent application entitled "Fuel Injection System", Ser. No. 629,421, filed Nov. 6, 1975. The cylinder is equipped with a spark plug 10 and a fuel injector 12 which may be actuated by electrically energizing its electromagnetic coil 14. The injector 12 is coupled to a constant pressure fuel source 16 and provides a volume of fuel to the area of the engine intake valve externally of the cylinder each time the injector 12 is actuated.

The spark plug 10 is energized by a conventional ignition coil 18 having its secondary circuit coupled to a rotor 20 of a distributor 22 driven by the engine. The spark plug 10 is connected to one of the distributor contacts, as are the other engine spark plugs. The primary circuit of the ignition coil 18 is energized by the vehicle battery 24 each time the breaker points 26 are closed. The closure of the breaker points 26, like the rotation of the distributor rotor 20, is powered by the engine and occurs in timed relation to the rotation of the engine. The breaker points 26 are shunted by a capacitor 28. Other forms of ignition systems, such as recently developed "solid state" systems, may be used with the invention.

The primary circuit of the ignition coil 18 is connected to a counter 29 which is advanced by the current pulses generated in the primary circuit by each actuation of the breaker points 26. The counter 29 has a number of output lines 30, equal to the number of injector circuits employed, which are sequentially energized as the counter 29 advances. The number of injector circuits employed depends upon the number of cylinders in the engine and the number of injectors 12 which share a common circuit.

Only a single injector circuit is illustrated in FIG. 1. That circuit, which receives one of the counter output lines 30, employs a variable width pulse generator 32 that also receives signals provided by engine sensors 34. These sensors 34 typically provide electric output signals proportional to the engine manifold pressure (typically less the atmosphere pressure, i.e., a vacuum), engine temperature, and the like. The variable width pulse generator 32 also has an additional input, provided on line 36, from the injector coil 14.

Each time the pulse generator 32 receives a triggering input signal from the counter 29 on line 30, it provides an output electrical pulse having a time duration which is a function of its inputs from the engine sensors 34 and from the injector coil 14 on line 36. This pulse is provided to a constant current drive circuit 38 which has its output connected to the injector coil 14. The constant current drive circuit 38 is described in my copending U.S. Pat. Applications Ser. No. 629,443, as well as my copending U.S. Pat. Application entitled "Fuel Injection System with Correction for Incidental System Variables", Ser. No. 629,353, filed Nov. 6, 1975. The other end of the coil 14 is grounded.

The circuit 38 provides a current pulse having the same time duration as the output from the variable width pulse generator 32. The value of the current in this pulse is constant, independent of variations in the resistance of the injector coil 14 which inevitably occur as the injector coil temperature changes. The coefficient of thermal resistivity of copper varies by about 0.4% per degree Centigrade. Since the injector 12 and the fuel contained therein are in close proximity to the engine, the fuel in the injector 12 will readily undergo a substantial change in temperature, thereby varying the density of the fuel adjacent to a metering nozzle in the injector 12. The coil 14 may undergo a 50% resistance change between cold start and warmed up engine operation, reflecting variations in the temperature of the fuel in the injector 12. As a result, the mass of weight of the fuel admitted to the engine cylinder will vary as a function of the injector temperature. The circuit 38 acts to provide a constant current to the coil 14 independent of its temperature. Thus, the voltage developed across the coil 14 will vary as a function of the temperature of coil 14. On this basis, the coil 14 may be used to sense the temperature of the fuel passing through the injector 12 adjacent to coil 14 which is in close proximity to a metering nozzle in the injector 12. A temperature sensing means, such as a thermistor, may in the alternative be provided in the injector 12 for fuel temperature sensing.

Line 36 connects the high voltage side of the coil 14 to the variable width pulse generator 32 to provide a voltage signal that varies directly with the resistance of the coil 14 during the occurrence of the actuating pulse and thus varies directly with the coil temperature and the fuel temperature. This signal acts to directly control the duration of the pulse provided by the generator 32, in a manner which will be subsequently described, so that the volume of fuel injected during each engine cycle will vary as a direct function of the fuel temperature in order to maintain the weight of the injected fuel constant, independent of fuel temperature.

Figure 2:
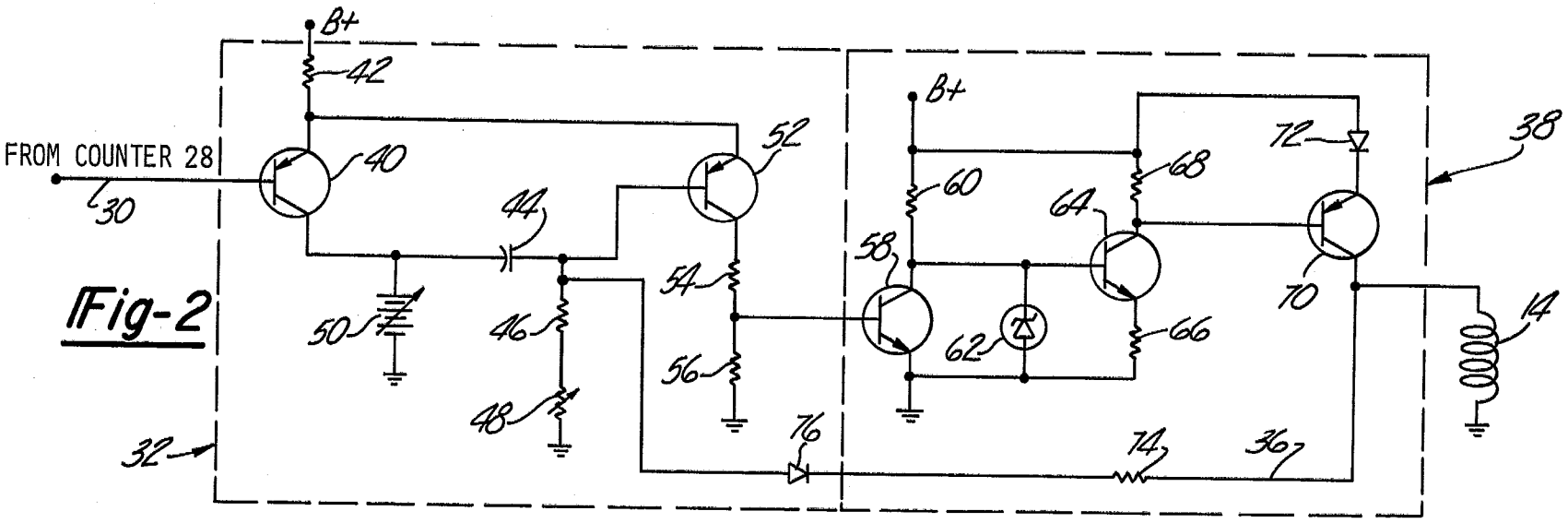
FIG. 2 is a more detailed electrical schematic diagram of portions of the system of FIG. 1.

The variable width pulse generator 32, the constant current drive circuit 38, and their associated circuitry, are illustrated in more detail in FIG. 2. The triggering input pulses to the pulse generator 32, on line 30, are applied to the base of a PNP transistor 40 having its emitter connected to a positive reference voltage through a resistor 42. The collector of transistor 40 is connected to one side of a capacitor 44 forming part of a resistance-capacitance timing circuit. The discharge resistance of the timing circuit is formed by the series combination of a resistor 46 and an engine sensor 48, forming part of the sensors 34 designated in FIG. 1. The sensor 48, acts in some respects like a variable resistor, and is schematically designated as such. Preferably, the sensor 48 is primarily sensitive to engine temperature, and may be a thermistor.

The collector of transistor 40 is also connected to ground through a device 50 which acts in some respects like a variable voltage source, and is schematically designated as such. The device 50 also forms part of the engine sensors 34, and in a preferred embodiment of the invention provides a voltage that is primarily a function of the engine manifold pressure although other combinations of parameters could be used to determine the voltage of device 50 in other embodiments of the invention.

The junction of the capacitor 44 and the resistor 46 is also connected to the base of a second PNP transistor 52 having its emitter connected to the emitter of transistor 40 and its collector connected to ground through a pair of resistors 54 and 56. The mid-point of resistors 54 and 56 represents the output of the circuit.

Referring to FIGS. 1 and 2 to consider the operation of the pulse generator 32, a triggering pulse on line 30 takes the form of a negative-going pulse and in the absence of this trigger the transistor 40 operates in a saturated conduction region. Transistor 52 is similarly conductive at this time so the voltage on capacitor 44 is substantially equal to the emitter voltage of transistor 52. Upon receipt of a negative-going pulse on line 30, transistor 40 is switched out of conduction, allowing the capacitor 44 to charge to a voltage dependent upon the difference between the emitter voltage of transistor 52 and the variable voltage provided by the device 50.

When the negative-going pulse to the base of transistor 40 terminates, the transistor 40 immediately becomes conductive again and the voltage at the base of transistor 52 goes sharply positive by an amount proportional to the charge of the capacitor 44, thereby turning off the transistor 52. Capacitor 44 then begins to discharge through resistor 46 and the equivalent resistance provided by the device 48. This discharge continues until the voltage across capacitor 44 reaches the emitter voltage of transistor 52, causing the transistor 52 to turn on, and to clamp the voltage on capacitor 44 to a value substantially equal to its emitter voltage.

The time during which transistor 52 is turned off is therefore dependent upon the variable voltage provided by the device 50, which controls the voltage to which the capacitor 44 charges during the off time of transistor 40, and to the effective sum of resistor 46 and the equivalent resistance provided by device 48. This sum controls the rate at which the capacitor 44 discharges after the transistor 40 becomes conductive. In the preferred embodiment of the invention, the pulse time is thus a function of both the engine manifold pressure and the engine temperature. During the discharge time of capacitor 44, a negative-going pulse is applied to the base of an NPN transistor 58, forming part of the constant current drive circuit 38 from the mid-point of the resistors 54 and 56 in the collector circuit of the transistor 52.

The collector of transistor 58 is connected to the positive terminal of a power supply through a resistor 60. The emitter of the transistor 58 is grounded so that it is biased to be conductive in the absence of a negative-going pulse at its base. A Zener diode 62 is connected across the emitter-collector circuit of transistor 58 so that the voltage at the collector of the transistor 58 is normally at ground and rises to the breakdown voltage of the diode 62 when a negative pulse is applied to its base and switches the transistor 58 into non-conduction.

The Zener diode limited voltage appearing at the collector of transistor 58 is applied to the base of a second NPN transistor 64. The emitter of transistor 64 is connected to ground through a resistor 66 and its collector is connected to the positive terminal of the power supply through a resistor 68. When the transistor 58 is switched into non-conduction by receipt of the pulse from the variable width pulse generator 32, the regulated Zener voltage is applied to the base of transistor 64 and the voltage across the resistor 66 rises to substantially the Zener voltage. The collector current of transistor 64 is substantially equal to its emitter current and both are highly stabilized by the action of the Zener diode 62.

The stabilized collector current of transistor 64 is applied to the base of a PNP output transistor 70 having its collector connected to the coil 14 of the injector 12. The emitter of transistor 70 is connected to the positive terminal of the power supply through a diode 72.

In the absence of a relatively large current on the base of transistor 70, the diode 72 biases the transistor 70 into cut-off so that no current is applied to the injector coil 14. When a negative-going pulse from the pulse generator 32 cuts off transistor 58, and provides a stabilized current to the base of transistor 64, transistor 70 is driven into a proportionally conductive current mode. The resultant collector current of transistor 70 flows through the injector coil 14 and is precisely controlled as a function of the voltage of the Zener diode 62. Variations in the resistance of the injector coil 14 which result from variations in its temperature or the temperature of the fuel passing through the injector 12 do not affect the current in coil 14. When the negative-going pulse from the generator 32 terminates, the bias provided to the transistor 70 by the diode 72 drives the transistor 70 sharply into non-conduction.

Line 36 connects the injector coil 14 and the collector of transistor 70 to the junction between the resistor 46 and capacitor 44 at the base of transistor 52 which provides a complex discharge path for the capacitor 44 and the pulse generator 32. The connection is through a calibrating resistance 74 and a diode 76. The diode 76 acts as a filter to limit the value of the positive-going injector actuation pulses upon turn-on of the transistor 70. The resistor 74 forward-biases the diode 76 at a predetermined voltage which substantially equals the voltage appearing at the base of transistor 52 during discharge of capacitor 44.

By this circuit, a voltage substantially equal to the stable voltage across the injector coil 14, during the receipt of an output pulse from transistor 70 is applied to the resistor 46. When diode 76 becomes forward-biased, a short discharge path for capacitor 44 is thereby provided, modifying the discharge time constant by a predetermined amount. As the temperature of the injector 12 increases, and the temperature of the coil 14 increases, increasing the coil resistance and the voltage that appears across the coil 14 when the constant current pulse is applied to it, the duration of a pulse from the generator 32 is increased. This corrects the fuel volume injected into the engine cylinder to compensate for the decrease in fuel density which occurs with increasing fuel temperature.

The voltage change occurring across the coil 14 as the coil temperature changes may be relatively large. Assuming the cold resistance of the coil to be about 2½ ohms, as it is in the preferred embodiment of the invention, after a 100° F. temperature increase occurs, the resistance appearing across coil 14 is about 3 ohms. The voltage will undergo the same percentage change.

Figure 3:
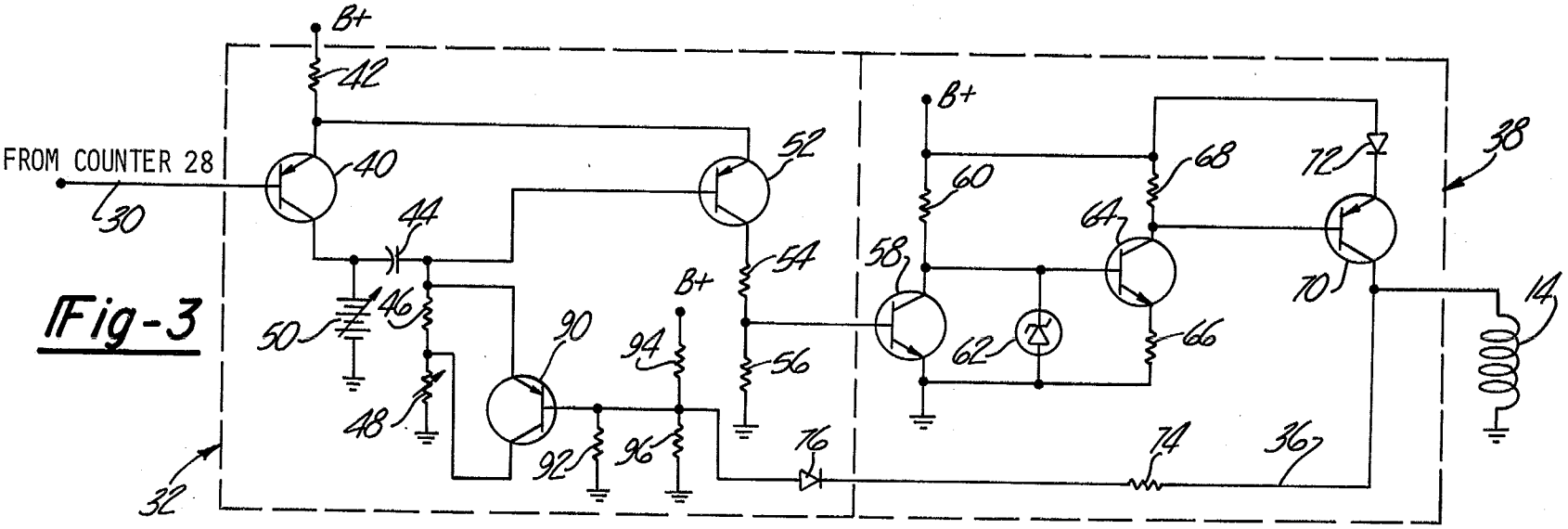
FIG. 3 is a detailed electrical schematic diagram of an alternative embodiment of the present invention.

FIG. 3 illustrates an alternative arrangement for modifying the discharge time for the R-C circuit in the pulse generator 32 as a function of the variation in the voltage across the injector coil 14. Most of the components of the circuit are the same as in the circuit of FIG. 2 and are given the same numbers. The circuit differs in that the resistance 46 is varied as a function of the voltage across the injector coil 14. The resistor 46 is shunted by the emitter-collector circuit of a PNP transistor 90. The base of the transistor 90 is connected to the coil 14 so that the conductivity of transistor 90 varies inversely with the coil voltage during an output pulse. This decreases the discharge time of the R-C circuit with a decrease in coil temperature or fuel temperature to compensate for changes in fuel density.

The embodiments of the invention in which an exclusive property or privilege is claimed are defined as follows:

1. In a fuel injection system for an internal combustion spark ignited engine including a source of fuel, at least one injector connected to the fuel source, said injector having an electric coil and being electrically controllable, means for measuring engine operating parameters, and means for controlling the injector to provide the engine with volumes of fuel which vary as a function of the measurements of the operating parameters the improvement comprising: means for generating an electrical signal proportional to the resistance of said coil for measuring the temperature of the fuel adjacent to the injector; means for generating variable width electrical pulses in timed relation to the operation of the engine for controlling the injector to vary the volume of fuel provided to the engine as a function of the output of said means for measuring engine operating parameters; and means for controlling the injector to modify the volume of fuel provided to the engine as a direct function of the output of said means for measuring the fuel temperature adjacent to the injector, whereby the weight of fuel provided to the engine is maintained independent of fuel density changes resulting from fuel temperature variation.

2. The fuel injection system of claim 1 wherein the injector comprises an electrically actuable nozzle and the volume of fuel provided to the engine is a function of the length of time that the nozzle is actuated.

3. The fuel injection system of claim 1 wherein said means for generating a variable width electrical pulse is connected to the injector coil and provides the coil with a current which is substantially independent of the coil resistance.

4. The fuel injection system of claim 3 in which said means for generating a variable width electrical pulse includes a resistance-capacitance discharge circuit, and the improvements and further including means, controlled by said means for measuring the fuel temperature, for modifying one of the constants of said resistance-capacitance circuit.

5. The fuel injection system of claim 4 wherein said means for varying one of the constants of the resistance-capacitance circuit as a function of the fuel temperature comprises a circuit connecting the injector coil to a resistance element of said resistance-capacitance discharge circuit.

6. A method of controlling the weight of fuel provided to an internal combustion spark ignited engine by a fuel injection system including an injector having an electromagnetic coil and means for energizing said coil to actuate the injector for a period of time which is a function of engine operating parameters, comprising: measuring the resistance of said coil and modifying the time of actuation of the injector as a direct function of the resistance of said coil to maintain the weight of fuel provided to the engine independent of the fuel temperature adjacent to the injector.

7. The method of claim 6 wherein said means for energizing the electromagnetic coil to actuate the injector for a period of time which is a function of the engine operating parameters provides said coil with an electrical current that is independent of the resistance of said coil, further comprising using the voltage across said coil as a measure of its resistance.

8. In a fuel injection system for an internal combustion spark ignited engine includng a source of fuel, an injector connected to the fuel source, said injector having an electric coil and being electrically controllable, means for measuring engine operating parameters, and means for controlling the injector to provide the engine with volumes of fuel which vary as a function of the measurements of the operating parameters, the improvement comprising: means for generating an electrical signal proportional to the resistance of the coil for measuring the temperature of the injector; means for generating variable width electrical pulses in timed relation to the operation of the engine for controlling the injector to vary the volume of fuel provided to the engine as a function of the output of said means for measuring engine operating parameters; and means for controlling the injector to modify the volume of fuel provided to the engine as a direct function of the output of said means for measuring the injector temperature, whereby the weight of fuel provided to the engine is maintained independent of fuel density changes resulting from fuel temperature variation.

9. The fuel injection system of claim 8 wherein the injector comprises an electrically actuable nozzle and the volume of fuel provided to the engine is a function of the length of time that the nozzle is actuated.

10. The fuel injection system of claim 8 wherein said nozzle comprises an electric coil and said means for measuring the injector temperature comprises means for generating an electrical signal proportional to the resistance of said coil.

11. The fuel injection system of claim 8 wherein said means for generating a variable width electrical pulse is connected to the injector coil and provides the coil with a current which is substantially independent of the coil resistance.

12. The fuel injection system of claim 11 in which said means for generating a variable width electrical pulse includes a resistance-capacitance discharge circuit, and the improvement further including means, controlled by said means for measuring the injector temperature, for modifying one of the constants of said resistance-capacitance circuit.

13. The fuel injection system of claim 12 wherein said means for varying one of the constants of the resistancecapacitance circuit as a function of the injector temperature comprises a circuit connecting the injector coil to a resistance element of said resistance-capacitance discharge circuit.

14. In a fuel injection system for an internal combustion, spark-ignited engine including: a source of fuel, at least one injector connected to the fuel source, the injector having an electrically actuable nozzle, the nozzle having an electric coil, means for measuring engine operating parameters and means for controlling the injector to provide volumes of fuel which vary as a function of the measurements of the engine operating parameters, said means for controlling the injector to vary the volume of fuel including means for generating variable width electrical pulses in timed relation to the operation of the engine, the improvement comprising: means for generating an electrical signal proportional to the resistance of said coil and thereby providing means for measuring the temperature of the fuel adjacent to the injector; and means for controlling the injector to modify the volume of fuel provided to the engine as a direct function of the output of said means for measuring the fuel temperature adjacent to the injector, whereby the weight of fuel provided to the engine is maintained independent of fuel density changes resulting from fuel temperature variation.

15. In a fuel injection system for an internal combustion, spark ignited engine including a source of fuel, at least one injector connected to the fuel source, the injector having an electrically actuable nozzle, the nozzle having an electric coil, means for measuring engine operating parameters and means for controlling the injector to provide volumes of fuel which vary as a function of the measurements of the engine operating parameters, said means for controlling the injector to vary the volume of fuel including means for generating variable width electrical pulses in timed relation to the operation of the engine, the improvement comprising: means for generating an electrical signal proportional to the resistance of said coil and thereby providing means for measuring the temperature adjacent to the injector; and means for controlling the injector to modify the volume of fuel provided to the engine as a direct function of the output of said means for measuring the temperature adjacent to the injector, whereby the weight of fuel provided to the engine is maintained independent of fuel density changes resulting from fuel temperature variation.

* * * * *